United States Patent [19]

Witting

[11] Patent Number: 4,972,120

[45] Date of Patent: Nov. 20, 1990

[54] HIGH EFFICACY ELECTRODELESS HIGH INTENSITY DISCHARGE LAMP

[75] Inventor: Harald L. Witting, Burnt Hills, N.Y.

[73] Assignee: General Electric Company, Schenectady, N.Y.

[21] Appl. No.: 348,433

[22] Filed: May 8, 1989

[51] Int. Cl.[5] ..... H01J 61/18

[52] U.S. Cl. ..... 313/638; 313/643; 315/248; 315/344

[58] Field of Search ..... 313/638, 640, 641, 643; 315/248, 344

[56] References Cited

U.S. PATENT DOCUMENTS 3,334,261 8/1967 Butler et al. ..... 313/641

4,591,759 5/1986 Chalek et al. ..... 313/638

4,783,615 11/1988 Dakin ..... 315/248

4,810,938 3/1989 Johnson et al. ..... 315/248

*Primary Examiner*—Kenneth Wieder

*Attorney, Agent, or Firm*—Jill M. Breedlove; James C. Davis, Jr.; Marvin Snyder

[57] ABSTRACT

Improved efficacy and color rendition are achieved in a high intensity discharge, solenoidal electric field (HID-SEF) lamp by using a novel combination of fill ingredients, including lanthanum halide, sodium halide, cerium halide, and xenon or krypton as a buffer gas. The preferred lamp structure is that of a short cylinder having rounded edges in order to achieve isothermal lamp operation and further efficacy improvement.

22 Claims, 2 Drawing Sheets

HIGH EFFICACY ELECTRODELESS HIGH INTENSITY DISCHARGE LAMP

FIELD OF THE INVENTION

The present invention relates generally to a class of high intensity discharge lamps for which the arc discharge is generated by a solenoidal electric field, i.e. HID-SEF lamps. More particularly, this invention relates to a novel combination of HID-SEF lamp fill ingredients resulting in improved efficacy and color rendition.

BACKGROUND OF THE INVENTION

In a high intensity discharge (HID) lamp, a medium to high pressure ionizable gas, such as mercury or sodium vapor, emits visible radiation upon excitation typically caused by passage of current through the gas. In the original class of HID lamps, discharge current was caused to flow between two electrodes. However, a major cause of early electroded HID lamp failure has been found attributable to at least two inherent operational characteristics of such lamps. First, during lamp operation, sputtering of electrode material onto the lamp envelope is common and reduces optical output. Second, thermal and electrical stresses often result in electrode failure.

Electrodeless HID lamps do not exhibit these life-shortening phenomena found in electroded HID lamps. One class of electrodeless HID lamps involves generating an arc discharge by establishing a solenoidal electric field in the gas; and, hence, these lamps are referred to as HID-SEF lamps. Unfortunately, HID-SEF lamps of the prior art have had limited applicability as described in U.S. Pat. No. 4,810,938, issued to P. D. Johnson, J. T. Dakin and J. M. Anderson on Mar. 7, 1989 and assigned to the instant assignee. As described in the cited patent, which is hereby incorporated by reference, one problem encountered in using electrodeless HID lamps is that their color rendering capability is inadequate for general purpose illumination. In particular, one requirement of general purpose illumination is that objects illuminated by a particular light source display substantially the same color as when illuminated by natural sunlight. A common standard used to measure this color rendering capability of a light source is the color rendering index (CRI) of the Commission Internationale de l'Eclairage (C.I.E.). For general lighting applications, a CRI value of 50 or greater is deemed necessary. Disadvantageously, color rendering capability of an HID lamp decreases with increasing efficacy. In the above-cited patent, however, it is recognized that a particular combination of fill materials can result in color improvement without adversely affecting lamp efficacy. Specifically, the lamp of the referenced patent utilizes a fill comprising sodium halide, cerium halide and xenon. Although at white color temperatures, this particular combination of fill ingredients provides improved efficacy and color rendition over the HID-SEF lamps of the prior art, it is desirable to find still other fill materials that will result in high efficacy and good color rendition.

OBJECTS OF THE INVENTION

Accordingly, it is an object of the present invention to provide a high intensity discharge, solenoidal electric field lamp which exhibits improved efficacy and color rendition at white color temperatures.

Another object of the present invention is to provide a fill for an HID-SEF lamp which optimizes lamp performance.

Still another object of the present invention is to provide an HID-SEF lamp having a structure which, in combination with a particular fill composition, results in improved efficacy and color rendition at white color temperatures.

SUMMARY OF THE INVENTION

The foregoing and other objects of the present invention are achieved in an HID-SEF lamp utilizing a particular structure and combination of fill materials to provide white color lamp emission at improved efficacy and color rendition. More specifically, the improved HID-SEF lamp of the present invention includes a light transmissive arc tube containing a fill which is mercury-free and comprises a combination of lanthanum halide, sodium halide, cerium halide, and a buffer gas such as xenon or krypton. These fill ingredients are combined in proper weight proportions to generate white color lamp emission at efficacies exceeding 160 lumens per watt (LPW) and color rendering index (CRI) values of at least 50. The white color temperature range for the improved HID-SEF lamp is from approximately 3,000° K. to approximately 4,500° K., thus being suitable for general illumination purposes. The preferred lamp structure is that of a short cylinder, or "pillbox", having rounded edges in order to achieve relatively isothermal operation.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
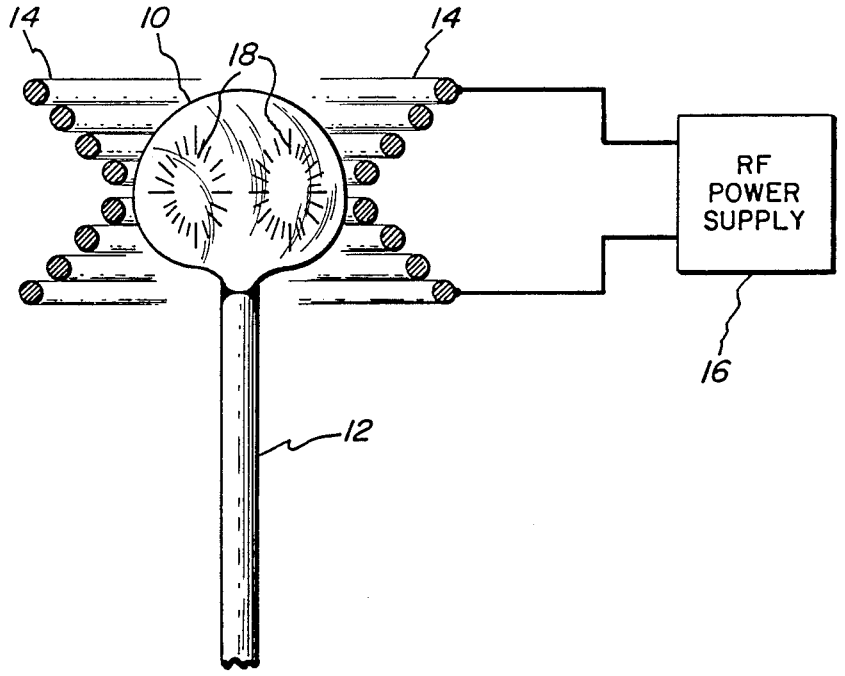
FIG. 1 is a partially cut-away view of an HID-SEF lamp of the present invention.

FIG. 1 shows an HID-SEF lamp of the present invention which includes an arc tube 10 supported by a rod 2. As illustrated, the preferred structure of arc tube 10 is that of a short cylinder, or "pillbox", having rounded edges. Such structure enables relatively isothermal operation, thus allowing the vapor pressures of the ingredients comprising the fill to reach the required levels without overheating the lamp. The arc tube is preferably formed of a high temperature glass, such as fused quartz, or an optically transparent ceramic, such as polycrystalline alumina.

Electrical power is applied to the HID-SEF lamp by an excitation coil 14 disposed about arc tube 10 and connected to a radio frequency (RF) power supply 16. In operation, RF current in coil 14 results in a changing magnetic field which produces within arc tube 10 an electric field which completely closes upon itself. Current flows through the fill within arc tube 10 as a result of this solenoidal electric field, producing a toroidal arc discharge 18 in arc tube 10. Suitable operating frequencies for the RF power supply are in the range from 1 megahertz to 30 megahertz, an exemplary operating frequency being 13.56 megahertz.

In accordance with the present invention, the HID-SEF lamp fill comprises lanthanum halide, sodium halide and cerium halide in weight proportions to produce white color lamp emission at improved efficacy and color rendition. Suitable halides are iodides, chlorides and bromides, including mixtures thereof. The preferred halides are iodides and chlorides, including mixtures thereof. With regard to specific weight proportions of fill ingredients, for every milligram of lanthanum halide used, there are preferably between approximately 0.5 and 3 milligrams of cerium halide used, and between approximately 0.5 and 5 milligrams of sodium halide used. The fill of the present invention further includes an inert buffer gas which preferably comprises xenon or krypton. The amount of xenon or krypton is present in a sufficient quantity to limit the transport of thermal energy by conduction from the arc discharge to the walls of the arc tube. The xenon or krypton is employed instead of mercury vapor, which has been conventionally used, in order to avoid the drawbacks of using mercury vapor, as described in U.S. Pat. No. 4,810,398 hereinabove cited.

Figure 2:
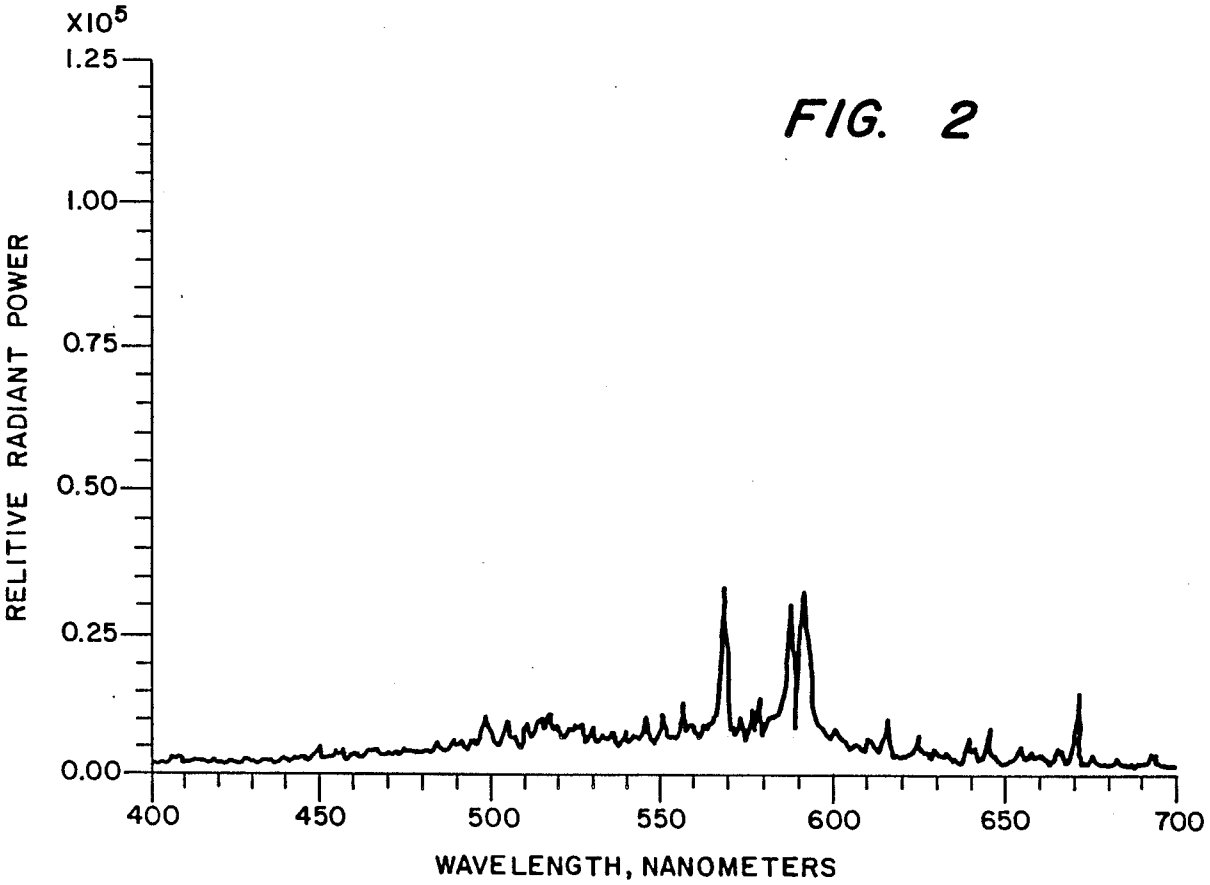
FIG. 2 is a spectral emission diagram for the HID-SEF lamp of FIG. 1 utilizing the arc tube fill composition of the present invention.

FIG. 2 is a spectral emission diagram for an HID-SEF lamp constructed in accordance with the present invention. The illustrated composite white color lamp emission is comprised of high pressure sodium and cerium emissions to which has been added lanthanum emission occurring in the 600–700 nanometer range. By thus adding a substance which emits in the red portion of the spectrum, i.e. 600–700 nanometers, color rendition is improved. The arc tube of the tested lamp having an outer diameter of 20 millimeters and a height of 17 millimeters, was filled with approximately 4.0 milligrams $LaI_3$, 3.2 milligrams $CeI_3$, 6.2 milligrams NaI and a sufficient quantity of xenon to provide a partial pressure of approximately 250 Torr. Specifically, at a color temperature of 4150° K. and an input power of 227 watts, the lamp exhibited an efficacy of 165 LPW and a 56 CRI value. The following examples illustrate other successfully tested arc tubes at between approximately 3,000° K. and 4,250° K. white color temperature for the HID-SEF lamp of the present invention.

EXAMPLE I

An arc tube having the same configuration and dimensions as the aforementioned tested lamp was filled with 2.0 milligrams $LaI_3$, 6.0 milligrams NaI, 3.0 milligrams $CeI_3$ and 250 Torr partial pressure of xenon. At approximately 201 watts input power, the lamp exhibited an efficacy of 166 LPW and a CRI value of 55.

EXAMPLE II

An arc tube having the same configuration and dimensions as those of the aforementioned tested lamps was filled with approximately 2.1 milligrams $LaI_3$, 6.3 milligrams NaI, 1.0 milligrams $CeI_3$ and approximately 250 Torr partial pressure of xenon. When supplied with 224 watts input power, the lamp exhibited an efficacy of 167 LPW and a CRI value of 47.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An electrodeless metal halide high intensity discharge lamp, comprising:

a light transmissive arc tube for containing an arc discharge;

a fill disposed in said arc tube, said fill including lanthanum halide, sodium halide and cerium halide, said halides being selected from the group consisting of iodides, chlorides and bromides, including mixtures thereof, said halides being combined in weight proportions to generate white color lamp emission exhibiting improved efficacy and color rendition;

said fill further including a buffer gas selected from the group consisting of xenon and krypton, said buffer gas being present in sufficient quantity to limit chemical transport of energy from said arc discharge to the walls of said arc tube; and excitation means for coupling radio frequency energy to said fill.

2. The lamp of claim 1 wherein said lanthanum halide comprises lanthanum iodide.

3. The lamp of claim 2 wherein said cerium halide and said sodium halide each comprise an iodide.

4. The lamp of claim 1 wherein said cerium halide and said sodium halide each comprise an iodide.

5. The lamp of claim 1 wherein said buffer gas comprises xenon.

6. The lamp of claim 5 wherein the quantity of xenon is sufficient to provide a partial pressure in the range of approximately 250 Torr and higher at the operating temperature of the lamp.

7. The lamp of claim 1 wherein said buffer gas comprises krypton.

8. The lamp of claim 7 wherein the quantity of krypton is sufficient to provide a partial pressure in the range of approximately 250 Torr and higher at the operating temperature of the lamp.

9. The lamp of claim 2 wherein said buffer gas comprises xenon.

10. The lamp of claim 9 wherein the quantity of xenon is sufficient to provide a partial pressure in the range of approximately 250 Torr and higher at the operating temperature of the lamp.

11. The lamp of claim 2 wherein said buffer gas comprises krypton.

12. The lamp of claim 11 wherein the quantity of krypton is sufficient to provide a partial pressure in the range of approximately 250 Torr and higher at the operating temperature of the lamp.

13. The lamp of claim 1 wherein said arc tube is substantially cylindrically shaped with the height of said arc tube being less than its outside diameter.

14. The lamp of claim 2 wherein said arc tube is substantially cylindrically shaped with the height of said arc tube being less than its outside diameter.

15. The lamp of claim 3 wherein said arc tube is substantially cylindrically shaped with the height of said arc tube being less than its outside diameter.

16. In an electrodeless metal halide high intensity discharge lamp having an arc tube for containing an arc discharge, an arc tube fill substantially free of mercury comprising:

lanthanum halide, sodium halide and cerium halide, said halides being selected from the group consisting of iodides, chlorides and bromides, including mixtures thereof, said halides being combined in weight proportions to generate white color lamp emission exhibiting improved efficacy and color rendition; and a buffer gas selected from the group consisting of xenon and krypton, said buffer gas being present in sufficient quantity to limit chemical transport of energy from said arc discharge to the walls of said arc tube.

17. The lamp of claim 16 wherein said lanthanum halide comprises lanthanum iodide.

18. The lamp of claim 17 wherein said cerium halide and said sodium halide each comprise an iodide.

19. The lamp of claim 16 wherein said buffer gas comprises xenon.

20. The lamp of claim 16 wherein said buffer gas comprises krypton.

21. The lamp of claim 17 wherein said buffer gas comprises xenon.

22. The lamp of claim 17 wherein said buffer gas comprises krypton.

* * * * *